US008267508B2

(12) United States Patent
Doo

(10) Patent No.: US 8,267,508 B2
(45) Date of Patent: Sep. 18, 2012

(54) INK JET PRINTER

(75) Inventor: Harumichi Doo, Hamamatsu (JP)

(73) Assignee: Roland DG Corporation, Hamamatsu-shi (JP)

( * ) Notice: Subject to any disclaimer, the term of this patent is extended or adjusted under 35 U.S.C. 154(b) by 319 days.

(21) Appl. No.: 12/725,412

(22) Filed: Mar. 16, 2010

(65) Prior Publication Data

US 2010/0238248 A1 Sep. 23, 2010

(30) Foreign Application Priority Data

Mar. 17, 2009 (JP) ..... 2009-64243

(51) Int. Cl.
*B41J 2/01* (2006.01)

(52) U.S. Cl. ..... 347/102; 347/5; 347/14; 347/22; 347/104; 400/621; 101/116; 101/117; 101/128.4; 33/18.1; 33/18.2

(58) Field of Classification Search ..... None
See application file for complete search history.

(56) References Cited

U.S. PATENT DOCUMENTS 3,550,276 A * 12/1970 Kramer et al. ..... 33/18.1
4,835,872 A * 6/1989 Alcantara et al. ..... 33/18.1
6,076,460 A * 6/2000 Kagawa ..... 101/128.4
6,575,553 B1 * 6/2003 Williams et al. ..... 347/22
6,832,831 B2 * 12/2004 Shima et al. ..... 347/102
6,926,400 B2 * 8/2005 Kelley ..... 347/104
6,990,899 B2 * 1/2006 Kato ..... 101/117
7,232,212 B2 * 6/2007 Iwase ..... 347/102
7,306,388 B2 * 12/2007 Acher ..... 400/621
7,396,173 B2 * 7/2008 Ahne et al. ..... 400/621
7,661,807 B2 * 2/2010 Nakano et al. ..... 347/102
7,794,076 B2 * 9/2010 Nakano et al. ..... 347/102
2007/0146458 A1 * 6/2007 Perego ..... 347/102

* cited by examiner

*Primary Examiner* — Matthew Luu
*Assistant Examiner* — John P Zimmermann
(74) *Attorney, Agent, or Firm* — Lee, Hong, Degerman, Kang & Waimey

(57) ABSTRACT

According to one embodiment, an ink jet recording apparatus includes: a guide rail extending in a first direction; an ink head that slidably engages with the guide rail and discharges an ultraviolet light curable ink toward a recording medium; a second head that slidably engages with the guide rail; a carriage that moves along the guide rail; a first connection mechanism that bridges the carriage and the ink head and detachably connects the carriage with the ink head; a second connection mechanism that detachably connects the carriage with the second head; and an ultraviolet light irradiation device that is attached to the ink head to move together with the ink head, that is positioned in front, in rear or below the first connecting mechanism when the carriage and the ink head are connected by the first connecting mechanism, and that irradiates the ultraviolet light curable ink discharged from the ink head on the recording medium with ultraviolet light.

12 Claims, 12 Drawing Sheets

INK JET PRINTER

Pursuant to 35 U.S.C. §119(a), this application claims the benefit of earlier filing date and right of priority to Japanese Patent Application No. 2009-64243, filed on Mar. 17, 2009, the contents of which are hereby incorporated by reference herein in its entirety.

BACKGROUND

1. Field

Embodiments of the present invention relate to an ink jet recording apparatus.

2. Discussion of the Related Art

Ink jet recording apparatuses equipped with an ink head that discharges ink onto a recording medium such as a sheet of recording paper and a cutting head that cuts the recording medium have conventionally been known. The ink head and the cutting head are engaged with a guide rail extending in a predetermined direction and are carried by a carriage that moves along the guide rail.

In an ink jet recording apparatus in which a carriage is built into a cutting head, the ink head and the cutting head are structured to be mutually and freely attachable and detachable. When a printing function by the ink head takes place, the cutting head and the ink head become connected. The ink head is then carried in the scanning direction in one piece with the cutting head by the carriage built into the cutting head. As the ink head moves in the scanning direction, it discharges ink droplets on the recording medium. The connection between the cutting head and the ink head is released when cutting the recording medium. The ink head then stands by at a predetermined standby position, i.e., a home position, and the cutting head alone is carried by the built-in carriage.

Also, an ink jet recording apparatus that uses ink curable upon irradiation of ultraviolet light (hereafter referred to as "ultraviolet light curable ink") as ink to be discharged from the ink head is known. The ink jet recording apparatuses that use the ultraviolet light curable ink are equipped with a device for irradiating ultraviolet light (hereafter referred to as an "ultraviolet light irradiation device") to cure the ink which has been discharged from the ink head on a recording medium. An ultraviolet light irradiation device that is attached to an ink head and carried in one piece with the ink head in the scanning direction is known. Such an ultraviolet light irradiation device is capable of irradiating ultraviolet light only on a necessary portion of the recording medium, thereby suppressing wasteful irradiation of ultraviolet light.

SUMMARY

According to one embodiment, an ink jet recording apparatus includes: a guide rail extending in a first direction; an ink head that slidably engages with the guide rail and discharges an ultraviolet light curable ink toward a recording medium; a second head that slidably engages with the guide rail; a carriage that moves along the guide rail; a first connection mechanism that bridges the carriage and the ink head and detachably connects the carriage with the ink head; a second connection mechanism that detachably connects the carriage with the second head; and an ultraviolet light irradiation device that is attached to the ink head to move together with the ink head, that is positioned in front, in rear or below the first connecting mechanism when the carriage and the ink head are connected by the first connecting mechanism, and that irradiates the ultraviolet light curable ink discharged from the ink head on the recording medium with ultraviolet light.

BRIEF DESCRIPTION OF THE DRAWINGS

The above and other aspects and features of the present disclosure will become more apparent upon consideration of the following description of embodiments, taken in conjunction with the accompanying drawing figures.

DETAILED DESCRIPTION

According to a previous ink jet recording apparatus, the carriage must carry both the ink head and the cutting head, although the cutting head is unnecessary for printing with the ink head. This causes a greater load on the carriage. In particular, when the ultraviolet light irradiation device is attached to the ink head, the carriage must carry the ink head, the ultraviolet light irradiation device, and the cutting head, which leads to an even greater load on the carriage.

One way to address this issue is to have the carriage be independent of the cutting head, so that the carriage is connected only to the ink head when printing with the ink head, and the carriage is connected only to the cutting head when cutting the recording medium. However, unless the connection mechanism for detachably connecting the carriage to the ink head and the ultraviolet light irradiation device are designed with certain contrivances, the ink jet recording apparatus would likely become large in size.

Embodiments of the present invention address such a problem, and aspects are directed to reduce the structural size of an ink jet recording apparatus equipped with a plurality of heads including an ink head for discharging ultraviolet light curable ink, and whose heads are carried independently of each other by a carriage.

According to embodiments of the present invention, it would be possible to reduce the size of an ink jet recording apparatus equipped with an ink head that discharges ultraviolet light curable ink and other heads, wherein the heads are carried independently of each other by a carriage.

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

Figure 1:
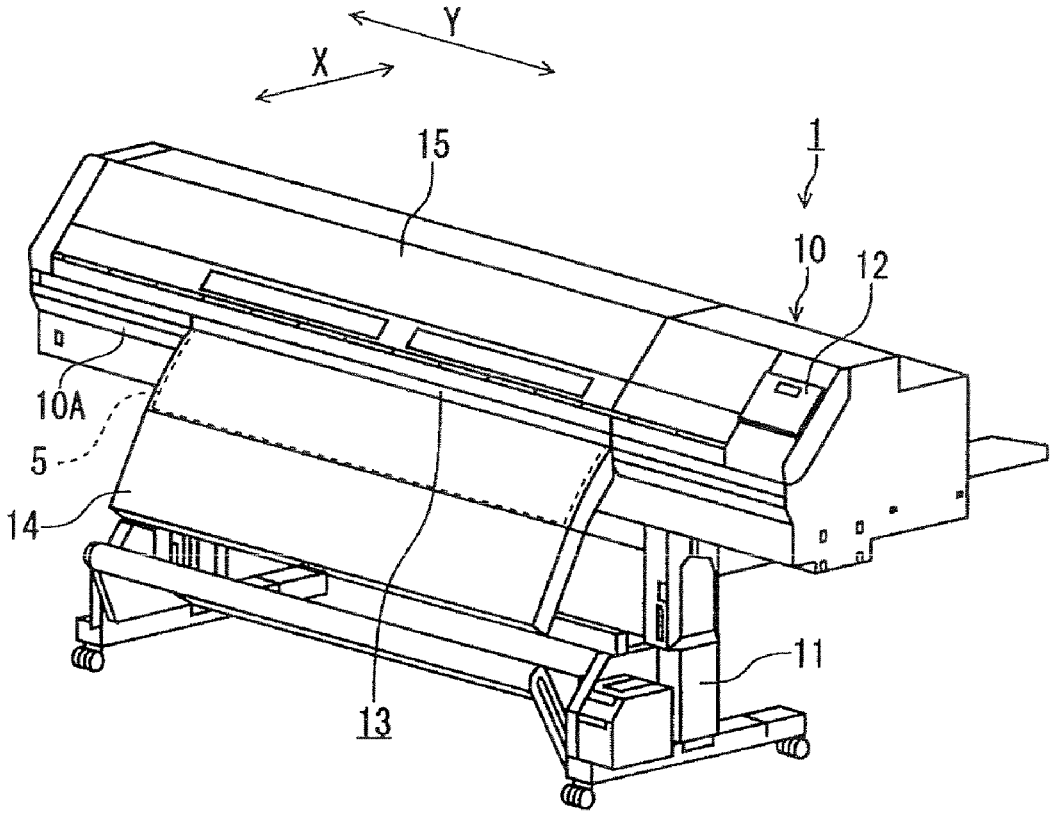
FIG. 1 is a perspective view of an ink jet printer according to one embodiment.

An ink jet recording apparatus in accordance with an embodiment of the invention may be an ink jet printer 1 with a cutting head, as shown in FIG. 1. The ink jet printer 1 is equipped with an ink head 40 and a cutting head 70, as described below (see FIG. 2). The ink jet printer 1 is capable of performing printing and cutting operations with respect to a sheet of recording paper 5. It is noted that an arrow Y shown in FIG. 1 indicates a primary scanning direction, and an arrow X indicates an auxiliary scanning direction that is a direction perpendicular to the primary scanning direction Y.

The ink jet printer 1 is provided with a main body 10 having a casing 10A that extends in the scanning direction Y, and legs 11 that support the main body 10. An operation panel 12 is provided on the right side of the main body 10.

The operation panel 12 may be equipped with a display section that displays operation states, a cursor key for designating the positions of the ink head 40 and the cutting head 70, a start region setting key for designating a region of a specified portion for which printing or cutting is to be started based on an image data signal, an operation start key for starting printing or cutting from the designated start region, and the like.

A front cover 15 that can be freely opened and closed is mounted on an upper portion of the main body 10. A discharge port 13 for discharging the recording paper 5 is formed in the main body 10 on its lower side. A guide 14 is provided at a position at the (or in) front of and below the discharge port 13 for guiding the recording paper 5 discharged from the discharge port 13 in a forwardly diagonal downward direction.

Figure 2:
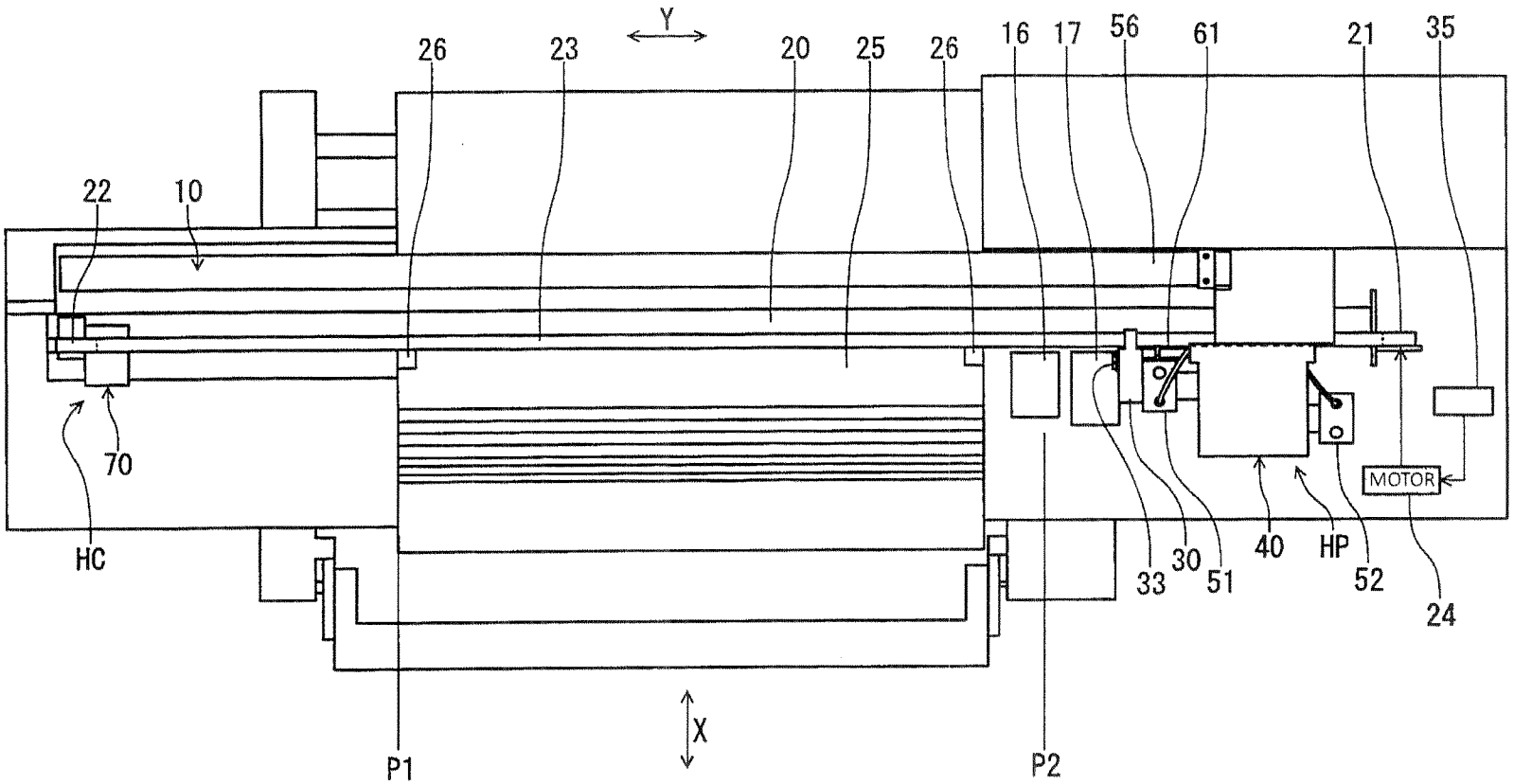
FIG. 2 is a plan view showing an internal structure of an ink jet printer in accordance with one embodiment.

Next, the internal structure of the main body 10 shall be described according to one embodiment. As shown in FIG. 2, a guide rail 20 extending in the primary scanning direction Y is provided inside the main body 10. When the ink jet printer 1 is viewed from the front, the primary scanning direction Y corresponds to a left-right direction, and the auxiliary scanning direction X corresponds to a front-rear direction. Accordingly, in the following description, the primary scanning direction Y may be suitably referred to as the left-right direction, and the auxiliary scanning direction X may be suitably referred to as the front-rear direction. A platen 25 is disposed in a central area and at the front of the guide rail 20. The platen 25 is a part for supporting the recording paper 5 during printing by the ink head 40 and during cutting of the recording paper 5 by the cutting head 70. Printing and cutting of the recording paper 5 are conducted on the platen 25.

Figure 4:
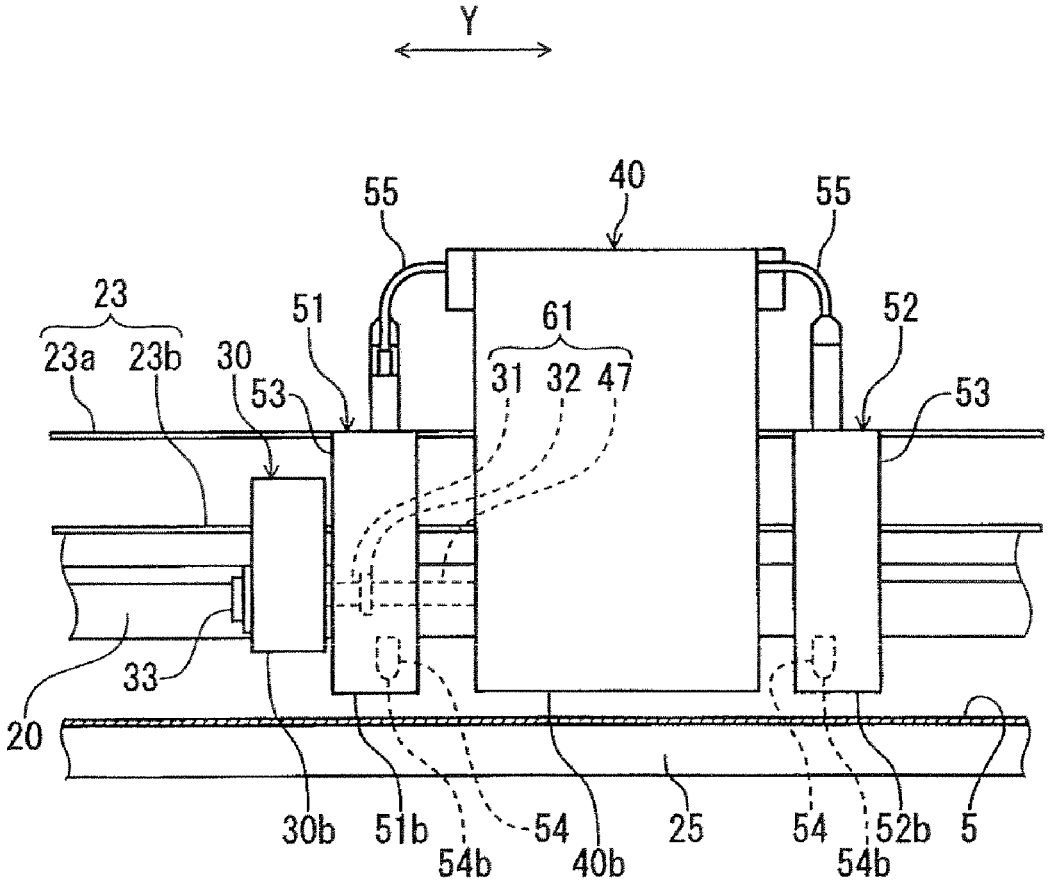
FIG. 4 is a front view showing the carriage and the ink head according to one embodiment.
Figure 5:
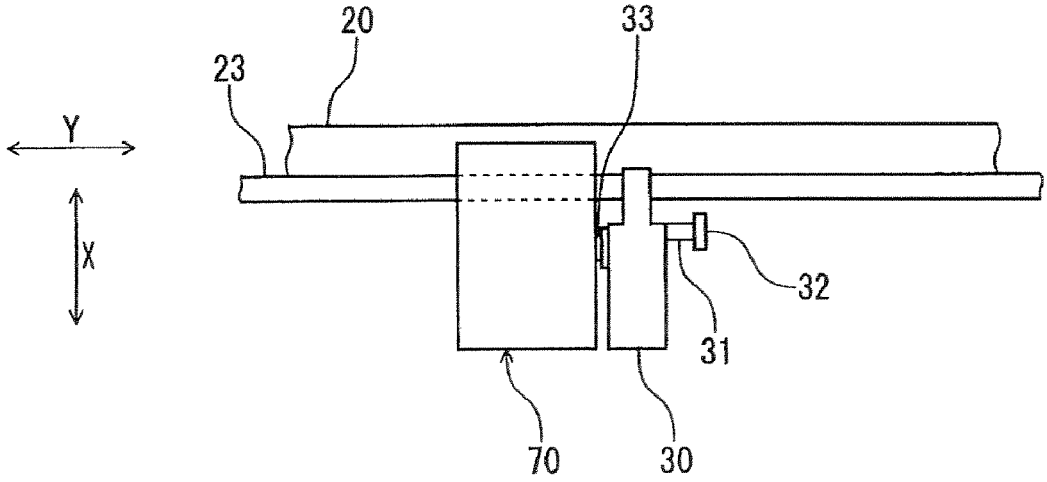
FIG. 5 is a plan view showing the carriage and a cutting head according to one embodiment.

A pulley 21 is provided adjacent to the right end section of the guide rail 20, and a pulley 22 is provided adjacent to the left end section of the guide rail 20. An endless belt 23 is wound around the pulley 21 and the pulley 22. In FIG. 4 and other drawings, the reference numeral 23*a* denotes an upper portion of the belt 23, and the reference numeral 23*b* denotes a lower portion of the belt 23. Referring back to FIG. 2, a servo motor 24 is connected to the pulley 21. When the servo motor 24 drives the pulley 21, the belt 23 is driven between the pulley 21 and the pulley 22. A control device 35 is communicably connected to the servo motor 24. The servo motor 24 is a motor that can be freely rotated in forward and reverse directions. The control device 35 controls the servo motor 24, thereby controlling movements of a carriage 30 to be described below. It is noted that, in accordance with the present embodiment, it is the pulley 21 that is driven, but it is understood that the pulley 22 may be driven instead.

Figure 3:
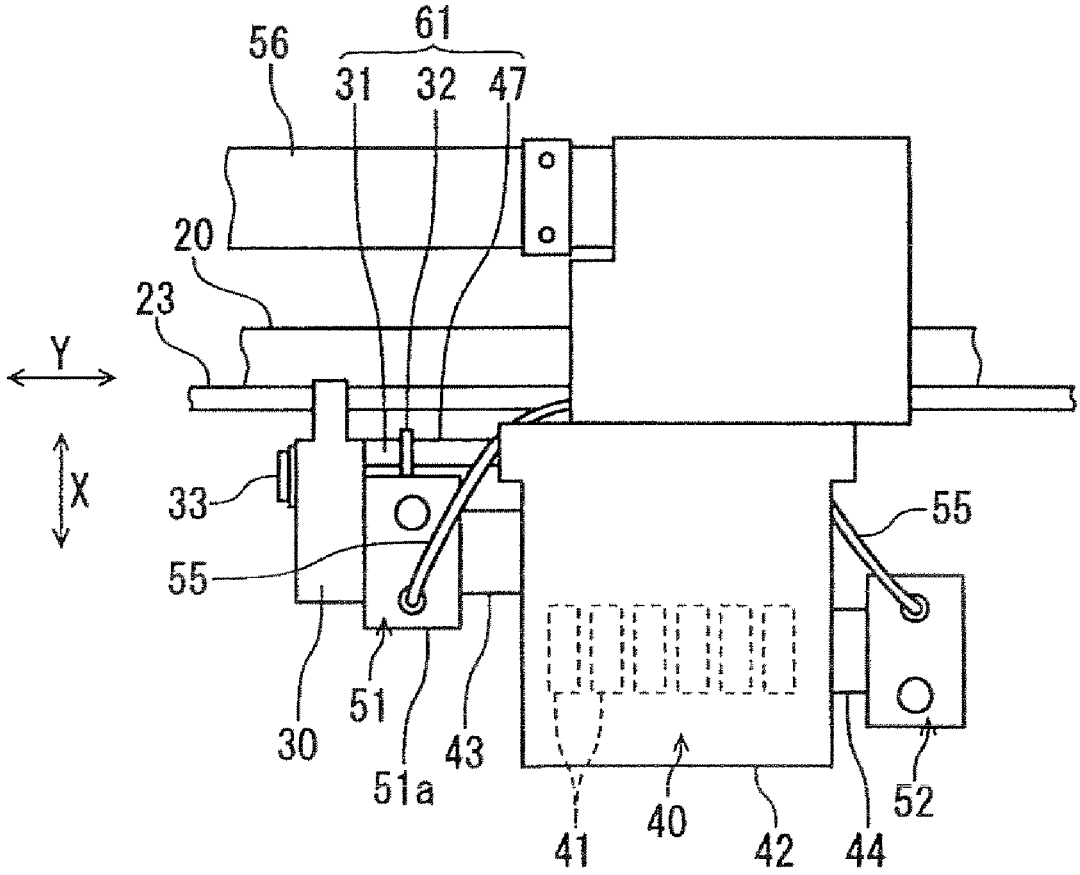
FIG. 3 is a plan view showing a carriage and an ink head according to one embodiment.

The carriage 30 is mounted on the belt 23 and engaged with the guide rail 20. Consequently, the carriage 30 moves in the left-right direction when the belt 23 is driven. As shown in FIG. 3, a connection member 31 extending to the right is fixed to the right side of the carriage 30. According to one embodiment, the connection member 31 is disposed in rear of the center position of the carriage 30 in the front-rear direction. A magnet 32 is attached to the right end section of the connection member 31. A magnet 33 is attached to the left side of the carriage 30. The connection member 31, the magnet 32, and the magnet 33 may be either separate from the carriage 30 or integrated with it. The connection member 31, the magnet 32, and the magnet 33 may be structural elements not clearly distinguishable in appearance from the carriage 30. The connection member 31, the magnet 32, and the magnet 33 move along (or together) with the carriage 30. For this reason, the carriage 30, the connection member 31, the magnet 32, and the magnet 33 may collectively be referred to as a "carriage." However, the carriage 30 is distinguished from the connection member 31, the magnet 32, and the magnet 33 in the present specification for purposes of description.

As shown in FIG. 2, a pair of upper and lower rollers 26 is provided at each of the left end section and the right end section of the platen 25 for feeding the recording paper 5 in the auxiliary scanning direction X. It is noted that FIG. 2 illustrates only the upper rollers 26. Among the pair of upper and lower rollers 26, one of the rollers 26 is a driving roller that rotates itself, and the other of the rollers 26 is a pinching roller for pinching the recording paper 5 with the driving roller. It is noted that the operation of the driving rollers is controlled by the control device 35. These rollers 26 form a transfer mechanism that transfers the recording paper 5 in the auxiliary scanning direction X. It is noted that the positions of the pair of upper and lower rollers 26 may not be limited, in particular, to the left end section and the right end section of the platen 25.

Next, the ink head 40 shall be described. The ink head 40 is a head that ejects ink toward the recording paper 5. With reference to FIG. 3, the ink head 40 has a plurality of print heads 41 each having nozzles for ejecting ink, and a print head carriage 42 that supports the print heads 41. The print head carriage 42 engages with the guide rail 20 in a manner freely moveable in the left-right direction. The print heads 41 eject ink droplets downward from the nozzles. An ink cartridge filled with ink is attached to the rear portion of the main body 10. The print heads 41 are connected to the ink cartridge through tubes. Ink is supplied to the print heads 41 from the ink cartridge described above. It is noted that the ejection operation of the ink head 40 is also controlled by the control device 35.

The ink head 40 ejects ink that is cured when irradiated with ultraviolet light, in other words, the ink head 40 ejects ultraviolet light curable ink. The ink jet printer 1 is equipped with first and second ultraviolet light light-emitting diodes (LEDs) 51 and 52 as ultraviolet light irradiation devices. The first ultraviolet light LED 51 is mounted to the left side of the print head carriage 42 through a connection member 43. The second ultraviolet light LED 52 is mounted to the right side of the print head carriage 42 through a connection member 44. According to one embodiment, the first ultraviolet light LED 51 and the second ultraviolet light LED 52 are disposed at positions mutually shifted (or offset from each other) in the front-rear direction. According to other embodiments, the first ultraviolet light LED 51 may be disposed in front of the second ultraviolet light LED 52, or both of the ultraviolet light LEDs 51 and 52 may be at the same position in the front-rear direction.

As shown in FIG. 4, the first ultraviolet light LED 51 is equipped with a case 53, a plurality of light emitting elements 54 provided inside the case 53, and a cable 55 for supplying electricity to the light emitting elements 54. The cable 55 is connected to a power supply through the cableveyor 56 (see FIG. 2). The second ultraviolet light LED 52 has a similar structure as that of the first ultraviolet light LED 51. The light emitting operation of both of the ultraviolet light LEDs 51 and 52 is also controlled by the control device 35.

The ultraviolet light LEDs 51 and 52 are closer to the platen 25 than the carriage 30. In other words, a bottom end 30*b* of the carriage 30 is positioned higher than respective bottom ends 51*b* and 52*b* of the ultraviolet light LEDs 51 and 52. In addition, the bottom end 30*b* of the carriage 30 is positioned higher than bottom ends 54*b* of the light emitting elements 54 of the ultraviolet light LEDs 51 and 52. Moreover, the bottom end 30*b* of the carriage 30 is positioned higher than a bottom end 40*b* of the ink head 40.

As shown in FIG. 3, a connection member 47 extending to the left is provided to the left and rear of the print head carriage 42. The connection member 31 is shorter than the connection member 47 in the left-right direction. The connection member 47 may be integrated with the print head carriage 42 or may be separate. At least the left end section of the connection member 47 is formed with a magnetic material. For this reason, when the magnet 32 comes in contact with the connection member 47, the connection member 47 is attracted by the magnet 32. As a result, the carriage 30 and the ink head 40 become connected to each other through the connection member 31, the magnet 32, and the connection member 47. When the belt 23 is driven with the ink head 40 at a fixed position and a leftward force is applied to the carriage 30, the magnet 32 is separated from the connection member 47. In other words, when the ink head 40 is fixed to the main body 10 at a home position HP (see FIG. 2) to be described below and the carriage 30 moves to the left, the connection between the carriage 30 and the ink head 40 is released. In this way, the connection member 31, the magnet 32 and the connection member 47 form a first connecting mechanism 61 that freely detachably couples the carriage 30 with the ink head 40. The first connecting mechanism 61 extends in the left-right direction and bridges the carriage 30 and the ink head 40.

As shown in FIG. 3, when the carriage 30 and the ink head 40 are connected to each other by the first connecting mechanism 61, the first connecting mechanism 61 is positioned in rear of the ultraviolet light LED 51. In other words, the ultraviolet light LED 51 and the first connecting mechanism 61 are positioned such that they overlap each other in the front-rear direction, when the ink head 40 is transferred by the carriage 30. However, the first connecting mechanism 61 and the ultraviolet light LED 51 may not necessarily be located at a position where they overlap each other in a top-down direction. In other words, the first connection mechanism 61 and the ultraviolet light LED 51 may be arranged at positions mutually shifted (or offset from each other) in the top-down direction. Even in this arrangement, the first connecting mechanism 61 and the ultraviolet light LED 51, as viewed in a plan view, overlap each other in the front-rear direction.

Figure 6:
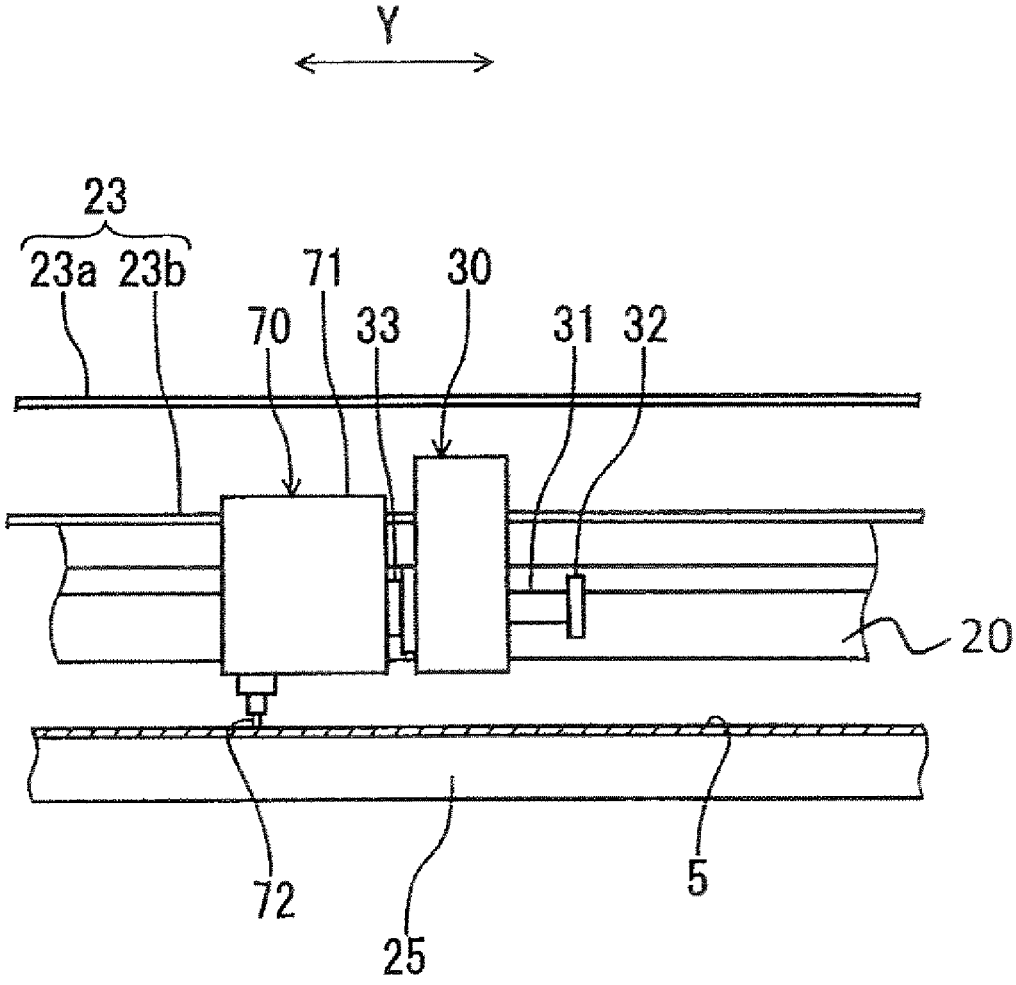
FIG. 6 is a front view showing the carriage and the cutting head according to one embodiment.

Next, the cutting head 70 will be described. The cutting head 70 is a head for cutting the recording paper 5. When the recording paper 5 is cut out, the cutting head 70 is moved by the carriage 30 in the primary scanning direction Y, while the recording paper 5 is moved by the rollers 26 in the auxiliary scanning direction X. Through such movements, the cutting head 70 can cut the recording paper 5 in a two-dimensional manner, and an arbitrary portion of the recording paper 5 can be cut or cut out. As shown in FIG. 6, the cutting head 70 is equipped with a cutter 72 and a case 71 that supports the cutter 72. The case 71 engages with the guide rail 20. Consequently, the cutting head 70 is guided by the guide rail 20 along the primary scanning direction Y.

At least a part of the case 71 that opposes the magnet 33 is formed with a magnetic material. For this reason, when the magnet 33 provided on the carriage 30 comes into contact with the case 71, the case 71 is attracted by the magnet 33. As a result, the carriage 30 and the cutting head 70 become connected to each other through the magnet 33. Conversely, when the belt 23 is driven with the cutting head 70 at a fixed position and a rightward force is applied to the carriage 30, the magnet 33 is separated from the case 71. In other words, when the cutting head 70 is fixed to the main body 10 at a home position HC (see FIG. 2) to be described below and the carriage 30 moves to the right, the connection between the carriage 30 and the cutting head 70 is released. In this way, the magnet 33 forms a second connecting mechanism that freely detachably couples the carriage 30 with the cutting head 70.

Next, operations of the ink jet printer 1 are described. As described above, the ink jet printer 1 is capable of printing with the ink head 40, and cutting with the cutting head 70.

Figure 7:
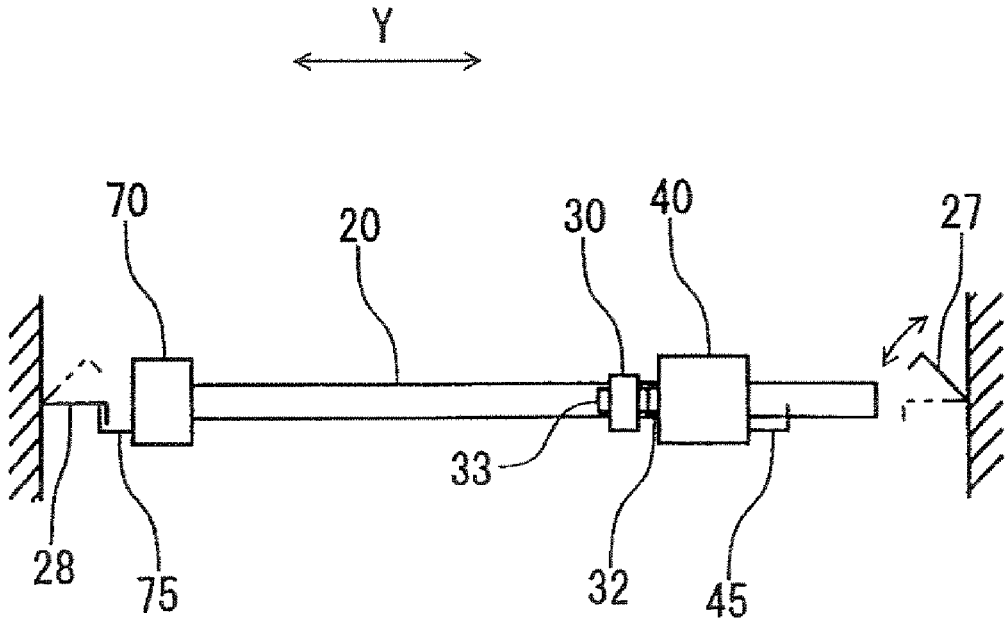
FIG. 7 is a front view illustrating the connection operation of the carriage according to one embodiment.

During printing, the cutting head 70 stands by at its home position HC (see FIG. 2) separated from the carriage 30. According to one embodiment, the left end section inside the main body 10 is the home position for the cutting head 70. As schematically shown in FIG. 7, an engaging member 75 is provided on the cutting head 70, and an engaging member 28, which can engage with and disengage from the engaging member 75 of the cutting head 70, is provided at the left end section of the main body 10. At the end of a cut-out process, the cutting head 70 is transferred to its home position HC by the carriage 30. When the cutting head 70 reaches the home position HC, the engaging member 28 goes from a disengaged state (i.e., a state indicated by a dotted line in FIG. 7) to an engaged state (i.e., a state indicated by a solid line in FIG. 7), so that it engages with the engaging member 75 of the cutting head 70. When the carriage 30 moves to the right in this state, the carriage 30 separates from the cutting head 70 against the magnetic force of the magnet 33 provided on the carriage 30. As a result, the cutting head 70 remains at the home position HC and stands by at the home position HC.

At the time of printing, the ink head 40 is connected to the carriage 30. The connection of the carriage 30 to the ink head 40 takes place at the home position HP for the ink head 40. According to the present embodiment, the right end section inside the main body 10 is the home position for the ink head 40.

A cap is provided at the lower side of the right end section inside the main body 10. When the ink head 40 stands by at the home position HP, it is positioned above the cap. At least the print heads 41 of the ink head 40 are covered from below by the cap. This suppresses drying of the ink in the print heads 41.

As shown in FIG. 2, a container 16 opened upward and a wiper 17 are disposed between the platen 25 and the cap. The container 16 serves to hold ink discharged from the print head 41. The ink inside the print head 41 increases in viscosity when it comes into contact with air. However, there is a possibility that the discharge performance (or behavior) of the ink head 40 may change if the ink viscosity were to increase. For this reason, the ink head 40 performs an operation to discharge ink towards the container 16 suitably to improve the reliability of its discharge performance. The container 16 is provided for collecting the ink discharged from the ink head 40 during such operations. The wiper 17 serves to clean nozzle surfaces of the print heads 41. When the ink head 40 passes over the wiper 17, the print heads 41 are suitably wiped by the wiper 17, thereby removing unnecessary ink and the like adhered to the print heads 41.

It is noted that, in accordance with the present embodiment as described above, the home position HP for the ink head 40 is provided at the right end section inside the main body 10. However, the positions of the home position HC for the cutting head 70 and of the home position HP for the ink head 40 may be reversed. That is, the home position HC for the cutting head 70 may be provided at the right end section inside the main body 10, and the home position HP for the ink head 40 may be provided at the left end section inside the main body 10.

When the carriage 30 moves to the right along the guide rail 20 while the ink head 40 stands by at the home position HP, the magnet 32 provided on the carriage 30 eventually comes into contact with the connection member 47 of the ink head 40, so that the carriage 30 and the ink head 40 become connected to each other through the magnet 32. As shown in FIG. 7, an engaging member 45 is provided on the ink head 40, while an engaging member 27, which can engage with and disengage from the engaging member 45, is provided at the right end section of the main body 10. In FIG. 7, the belt 23 and the ultraviolet light LEDs 51 and 52 are not shown. At the time of printing, the engaging member 27 is in a disengaged state (shown as a solid line in FIG. 7), which releases the engagement between the engaging member 45 provided on the ink head 40 and the engaging member 27 of the main body 10. As a result, when the carriage 30 moves in the primary scanning direction Y, the ink head 40 moves in the primary scanning direction Y along with the carriage 30.

The ink head 40 ejects ink toward the recording paper 5 while reciprocally moving in the primary scanning direction Y. The recording paper 5 is transferred by the rollers 26 in the auxiliary scanning direction X, in coordination with the reciprocal movements of the ink head 40. For example, as the ink head 40 is moved from one side to the other side in the primary scanning direction Y, the recording paper 5 is transferred forward by a predetermined length; as the ink head 40 is reversed and moved from the other side to the one side, the recording paper 5 is again transferred forward by a predetermined length, and then similar operations are repeated. By these operations, a two-dimensional image and the like are formed on the recording paper 5. Also, the ultraviolet light LEDs 51 and 52 suitably emit light in coordination with the movements of the ink head 40 in the primary scanning direction Y. By this, ultraviolet light is irradiated on the ink droplets discharged on the recording paper 5. Then, the ink droplets on the recording paper 5 is cured, and fixed on the recording paper 5.

During a cut-out process, the ink head 40 stands by at the home position HP separated from the carriage 30. When the printing operation is finished, the ink head 40 is carried by the carriage 30 to the home position HP. When the ink head 40 reaches the home position HP, the engaging member 27 goes from a disengaged state (i.e., a state indicated by a solid line in FIG. 7) to an engaged state (i.e., a state indicated by a dotted line in FIG. 7), so that it engages with the engaging member 45 of the ink head 40. When the carriage 30 moves to the left in this state, the carriage 30 separates from the ink head 40 against the magnetic force of the magnet 32 provided on the carriage 30. As a result, the ink head 40 remains at the home position HP and stands by at the home position HP.

During the cut-out process, the cutting head 70 is connected to the carriage 30. The connection between the carriage 30 and the cutting head 70 takes place at the home position HC for the cutting head 70. When the carriage 30 moves to the left along the guide rail 20 while the cutting head 70 stands by at the home position HC, the magnet 33 provided on the carriage 30 eventually comes into contact with the cutting head 70, so that the carriage 30 and the cutting head 70 become connected to each other through the magnet 33. In the cut-out process, the engaging member 28 is in a disengaged state, which releases the engagement between the engaging member 75 provided on the cutting head 70 and the engaging member 28 of the main body 10. As a result, when the carriage 30 moves in the primary scanning direction Y, the cutting head 70 moves in the primary scanning direction Y along with the carriage 30.

When the cutting head 70 moves to a predetermined position on the recording paper 5, the cutter 72 of the cutting head 70 (see FIG. 6) descends and cuts into the recording paper 5. As the cutting head 70 moves in the primary scanning direction Y, while the cutter 72 cuts the recording paper 5, the recording paper 5 is transferred by the rollers 26 in the auxiliary scanning direction X. This allows the recording paper 5 to be cut in a predetermined shape.

Figure 8:
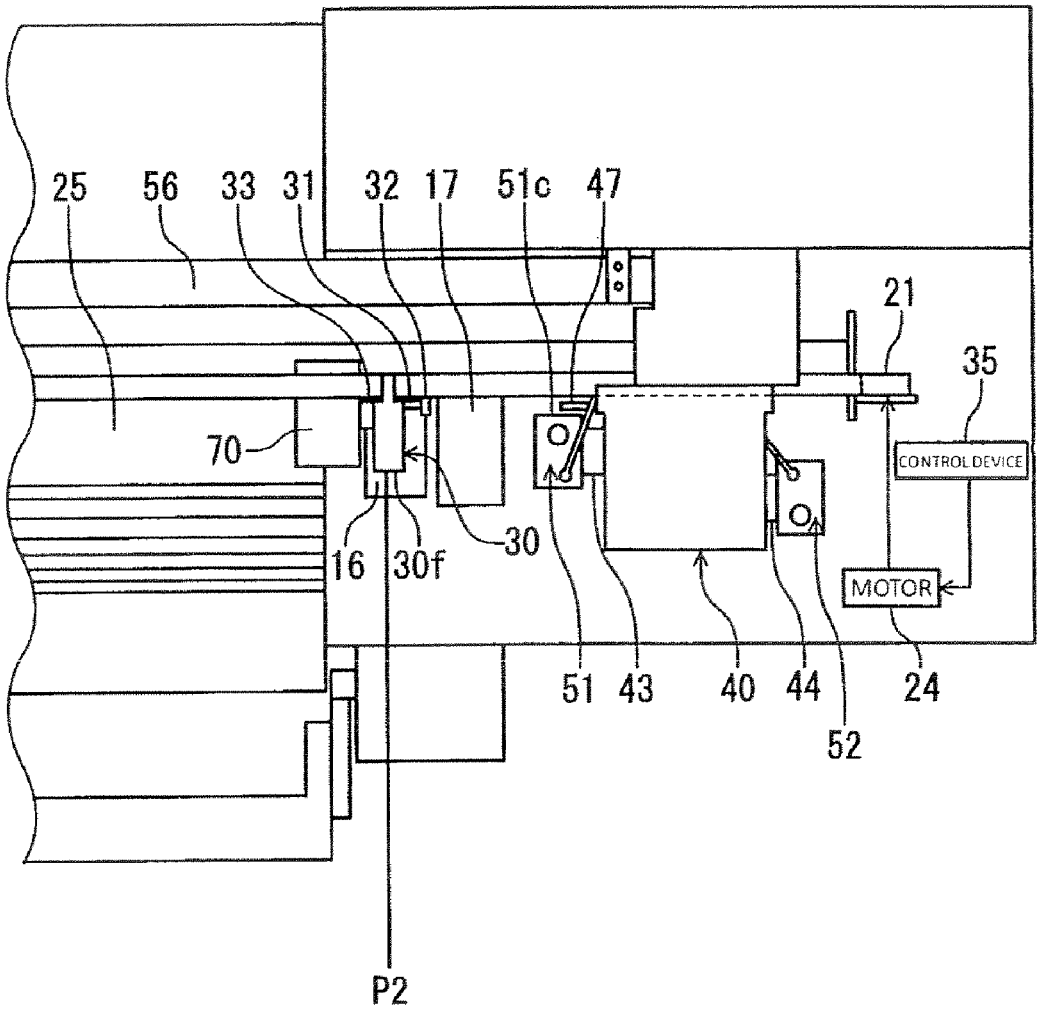
FIG. 8 is a plan view showing the carriage as it moves to a second reversing position according to one embodiment.

The carriage 30 connected to the cutting head 70 is controlled to reciprocate between a first reversing position P1 (see FIG. 2) located on the left end side of the guide rail 20 and a second reversing position P2 located on the right end side of the guide rail 20. The first reversing position P1 in FIG. 2 is shown as but one example. It is understood that the first reversing position P1 is not limited to the position shown in FIG. 2. FIG. 8 shows a state in which the carriage 30 connected to the cutting head 70 moves to the second reversing position P2 shown in FIG. 2. As shown in FIG. 8, as the carriage 30 connected to the cutting head 70 moves to the second reversing position P2, it maintains a state of being separated (or spaced apart) from the ultraviolet light LED 51, and its front end 30*f* is positioned frontward of a rear end 51*c* of the ultraviolet light LED 51. In other words, at least a part of the carriage 30 overlaps the ultraviolet light LED 51 in the front-rear direction when the carriage is at the second reversing position P2.

As described above, according to the ink jet printer 1 in accordance with embodiments of the invention, the carriage 30 transfers the ink head 40 without the cutting head 70 when printing, and the cutting head 70 without the ink head 40 when cutting. Therefore, the load on the carriage 30 can be reduced.

Also, according to embodiments of the invention, as shown, for example, in FIG. 3, when the carriage 30 and the ink head 40 are connected by the first connecting mechanism 61, the ultraviolet light LED 51 is positioned in front of the first connecting mechanism 61. Therefore, the length, relative to the left-right direction, of the carriage 30, the first connecting mechanism 61, the ink head 40 and the ultraviolet light LED 51 as a whole can be reduced. Accordingly, the ink jet printer 1, which may be capable of using the ink head 40 for ejecting ultraviolet light curable ink and using the cutting head 70, can achieve both a reduction in the load on the carriage 30 and a reduction in the size of the printer itself.

The ultraviolet light LED 51 may be located in rear of or below the first connecting mechanism 61 when the carriage 30 and the ink head 40 are connected by the first connecting mechanism 61. In other words, the first connecting mechanism 61, when connecting the carriage 30 and the ink head 40, may be located in front of or above the ultraviolet light LED 51. Such a configuration can also provide the effect described above.

As shown in FIG. 4, the lower end 30*b* of the carriage 30 is located above the respective lower ends 51*b* and 52*b* of the ultraviolet light LEDs 51 and 52. Because the carriage 30 is disposed at a relatively higher position, contact between the carriage 30 and the recording paper 5 can be more reliably prevented. In addition, because the ultraviolet light LEDs 51 and 52 are arranged at a relatively low position, the efficiency of ultraviolet light irradiation can be improved.

Also, the lower end 30*b* of the carriage 30 is located above the lower end 40*b* of the ink head 40. As described above, because the carriage 30 is disposed at a relatively higher position, contact between the carriage 30 and the recording paper 5 can be more reliably prevented. Because the ink head 40 is disposed at a relatively lower position, deviations in landing positions of ink droplets with respect to the recording paper 5 can be more effectively reduced. Accordingly, the print quality can be improved.

Referring to the embodiment of FIG. 8, as the carriage 30 connected to the cutting head 70 moves to the second reversing position P2, it maintains a state of being separated (or spaced apart) from the ultraviolet light LED 51, and its front end 30*f* is positioned in front of the rear end 51*c* of the ultraviolet light LED 51. As such, even when the carriage 30 moves to a position closest to the ink head 40, the carriage 30 and the ultraviolet light LED 51 are still separated (or spaced apart) from each other. Therefore, interference between them can be avoided. Furthermore, the carriage 30 and the ultraviolet light LED 51 are positioned to overlap each other in the front-rear direction. Therefore, the length of the carriage 30, the ultraviolet light LED 51 and the ink head 40 as a whole can be reduced in the front-rear direction. Accordingly, the size of the ink jet printer 1 can be reduced.

As shown in FIG. 3, the guide rail 20 is disposed in rear of the ink head 40 (e.g., the intermediate position of the ink head 40) in the front-rear direction, and the first connecting mechanism 61 is disposed in rear of the front end 51*a* of the ultraviolet light LED 51. Because the first connecting mechanism 61 is disposed in relative proximity to the guide rail 20, the probability of looseness developing between connecting members of the first connecting mechanism 61 is reduced. Therefore, the reliability of the connection between the carriage 30 and the ink head 40 can be improved.

Similarly, the guide rail 20 is disposed in rear of the intermediate position of the ink head 40 in the front-rear direction, and the magnet 33 (that may form a second connecting mechanism) is disposed in rear of the front end 51*a* of the ultraviolet light LED 51. As such, the magnet 33 is also disposed in relative proximity to the guide rail 20, such that the reliability of the connection between the carriage 30 and the cutting head 70 can also be improved.

Figure 9:
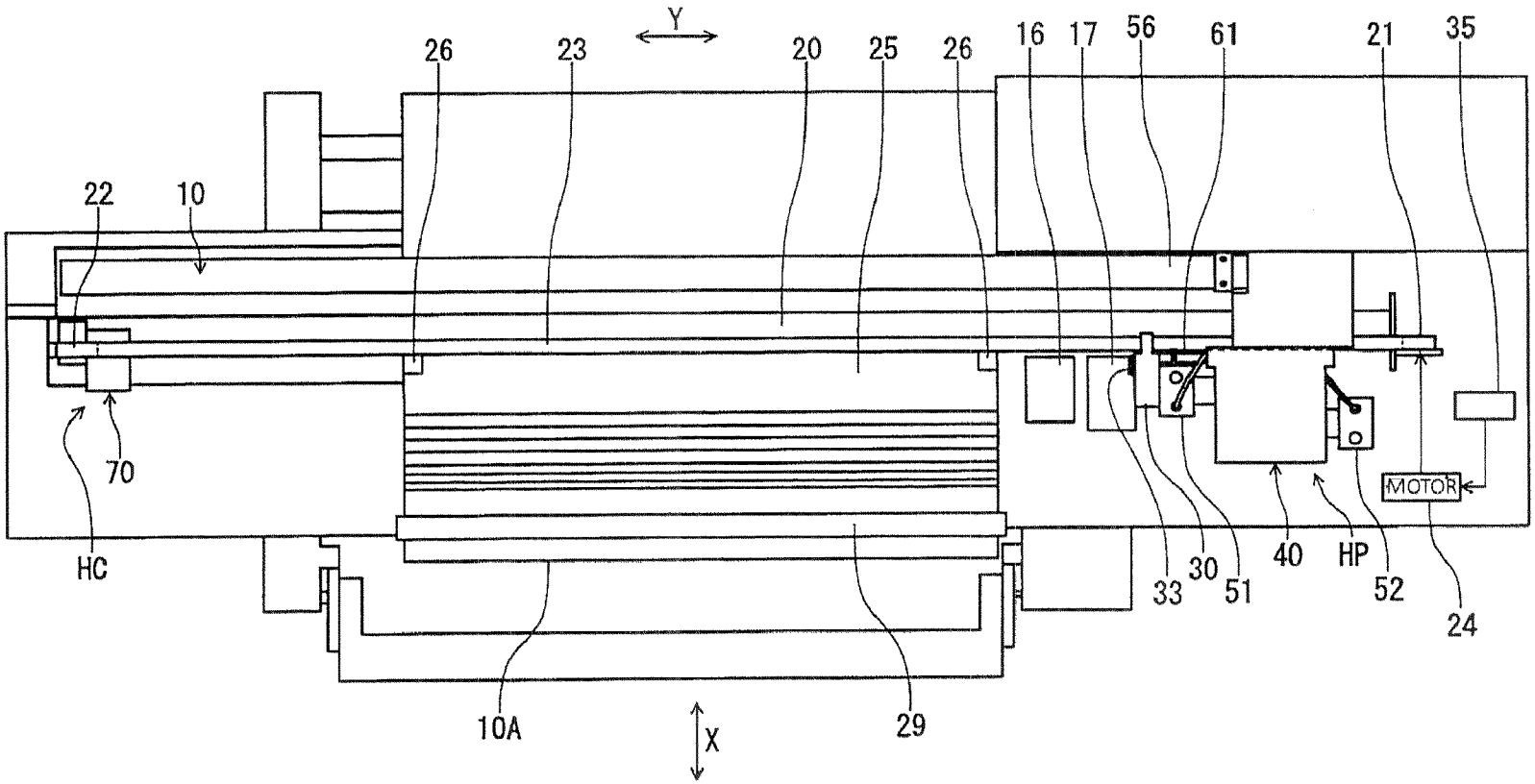
FIG. 9 is a plan view showing an internal structure of an ink jet printer in accordance with another embodiment.

With reference to FIG. 9, an ink jet recording apparatus in accordance with another embodiment will now be described. An ultraviolet light LED 29 that extends in the left-right direction is provided in front of the platen 25 in the ink jet printer. Other structural features are similar to those of embodiments previously described, and, therefore, only features significantly different from those of previously described embodiments will be described below.

The ultraviolet light LED 29 is affixed to the casing 10A of the main body 10. The ultraviolet light LED 29 extends parallel to the guide rail 20 and is positioned in front of the guide rail 20. The ultraviolet light LED 29 has a plurality of light emitting elements that may be arranged in the left-right direction. The ultraviolet light LED 29 is placed between the home position HC for the cutting head 70 and the home position HP for the ink head 40 in the left-right direction.

When the recording paper 5 is transferred (or advanced) frontward by the rollers 26, the ultraviolet light LED 29 irradiates ultraviolet light curable ink on the recording paper 5 with ultraviolet light. The ultraviolet light curable ink has a certain viscosity. Therefore, immediately after being discharged from the ink head 40, the ultraviolet light curable ink may not be uniformly spread on the recording paper 5, which would cause irregularities on the surface of the recording paper. However, after a certain period of time has passed, the ultraviolet light curable ink becomes uniformly spread on the recording paper 5, and its surface becomes smooth. When the ink that is in this state is irradiated with ultraviolet light, the finished print can have a smoothly finished appearance. The ultraviolet light LED 29 can be used for the purpose of, for example, forming a smooth print surface.

In accordance with the embodiment of FIG. 9, effects similar to those of previously described embodiments can be obtained. In addition, prints of a greater variety may be achieved, such as, for example, prints having a smooth print surface, and the like. The ultraviolet light LED 29 is disposed to the right of the home position HC for the cutting head 70, and disposed to the left of the home position HP for the print head 40. Therefore, when the ink head 40 is moved to its home position HP, maintenance work can be performed on the ink head 40 or the ultraviolet light LEDs 51 and 52 without physical interference by the ultraviolet light LED 29. Similarly, when the cutting head 70 is moved to its home position HC, maintenance work can be performed on the cutting head 70 without physical interference by the ultraviolet light LED 29.

Also, the ultraviolet light LED 51 is attached to the ink head 40 on the left side thereof, and the ultraviolet light LED 52 is attached to the ink head 40 on the right side thereof. In other words, the ultraviolet light LED 51, the ultraviolet light LED 52 and the ultraviolet light LED 29 are provided as ultraviolet light irradiation devices. However, the ultraviolet light LED 51 or the ultraviolet light LED 52 may be omitted.

Figure 10:
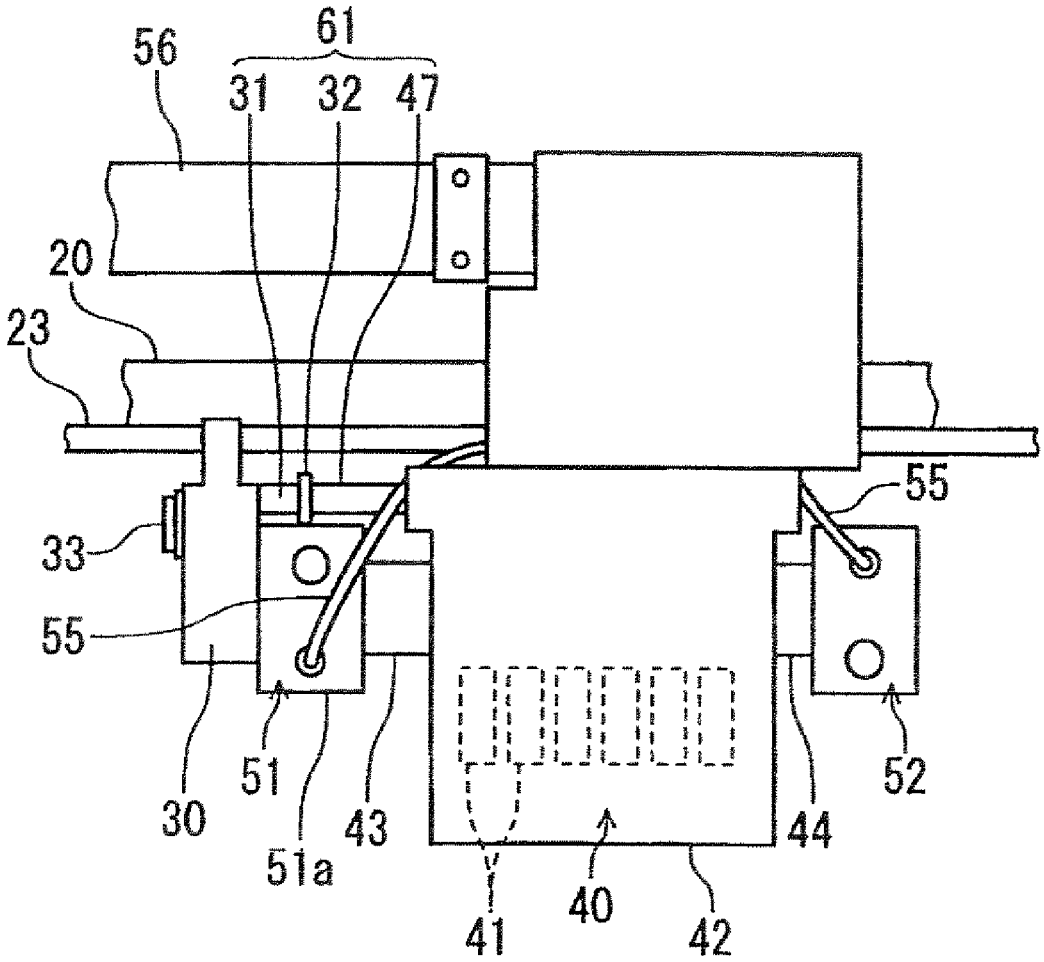
FIG. 10 is a plan view of an ink head and an ultraviolet light LED in accordance with another embodiment.
Figure 11:
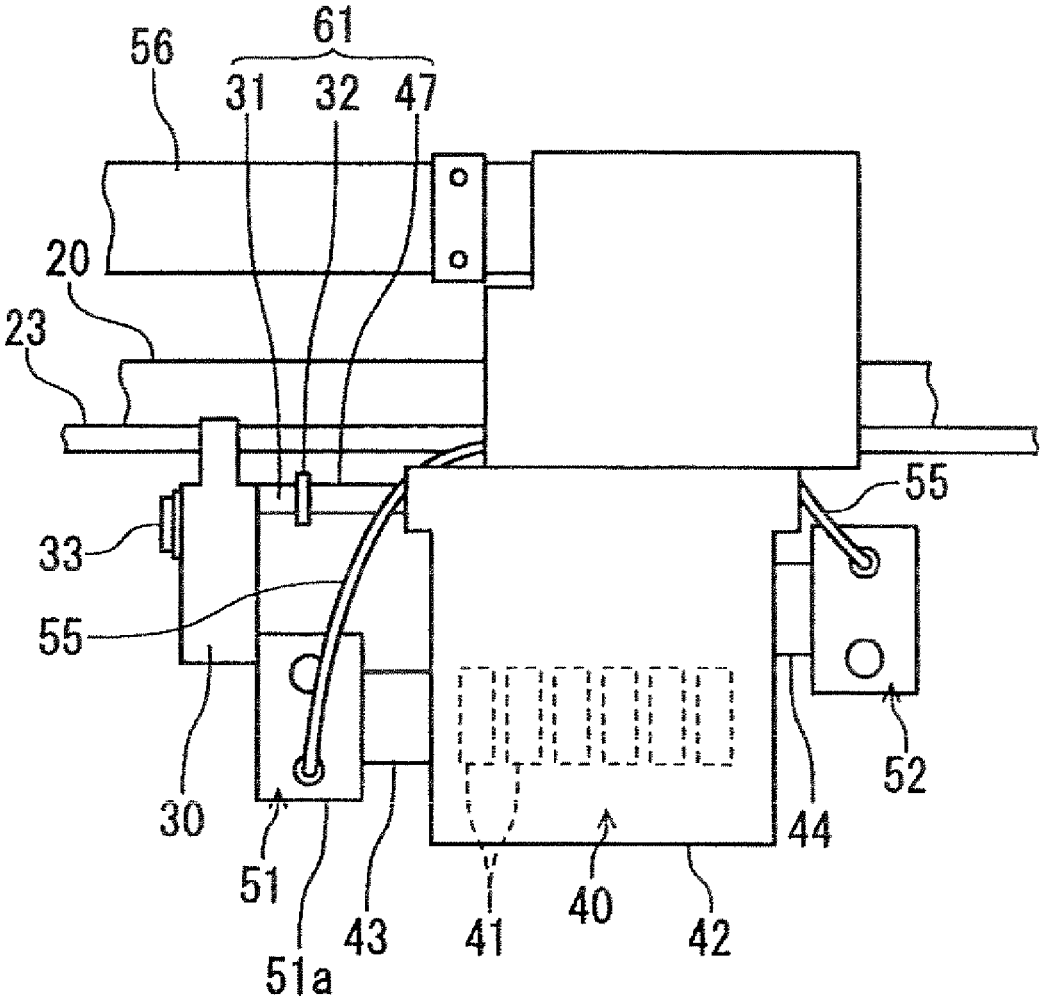
FIG. 11 is a plan view of an ink head and an ultraviolet light LED in accordance with still another embodiment.

In embodiments described above, the second ultraviolet light LED 52 is disposed in front of the first ultraviolet light LED 51, as shown, for example, in FIG. 3. However, the front-rear positional relationship between the first ultraviolet light LED 51 and the second ultraviolet light LED 52 is not limited, in particular, to this arrangement. For example, according to another embodiment, as shown in FIG. 10, the first ultraviolet light LED 51 and the second ultraviolet light LED 52 may be disposed at the same position in the front-rear direction. Also, according to another embodiment, as shown in FIG. 11, the second ultraviolet light LED 52 may be disposed in rear of the first ultraviolet light LED 51.

In embodiments described above, the device that irradiates the ultraviolet light curable ink with ultraviolet light is an ultraviolet light LED. However, the ultraviolet light irradiation device is not limited to ultraviolet light LEDs, and a variety of other types of irradiation devices can be used. For example, a halogen lamp or the like may also be used as the ultraviolet light irradiation device.

Figure 12:
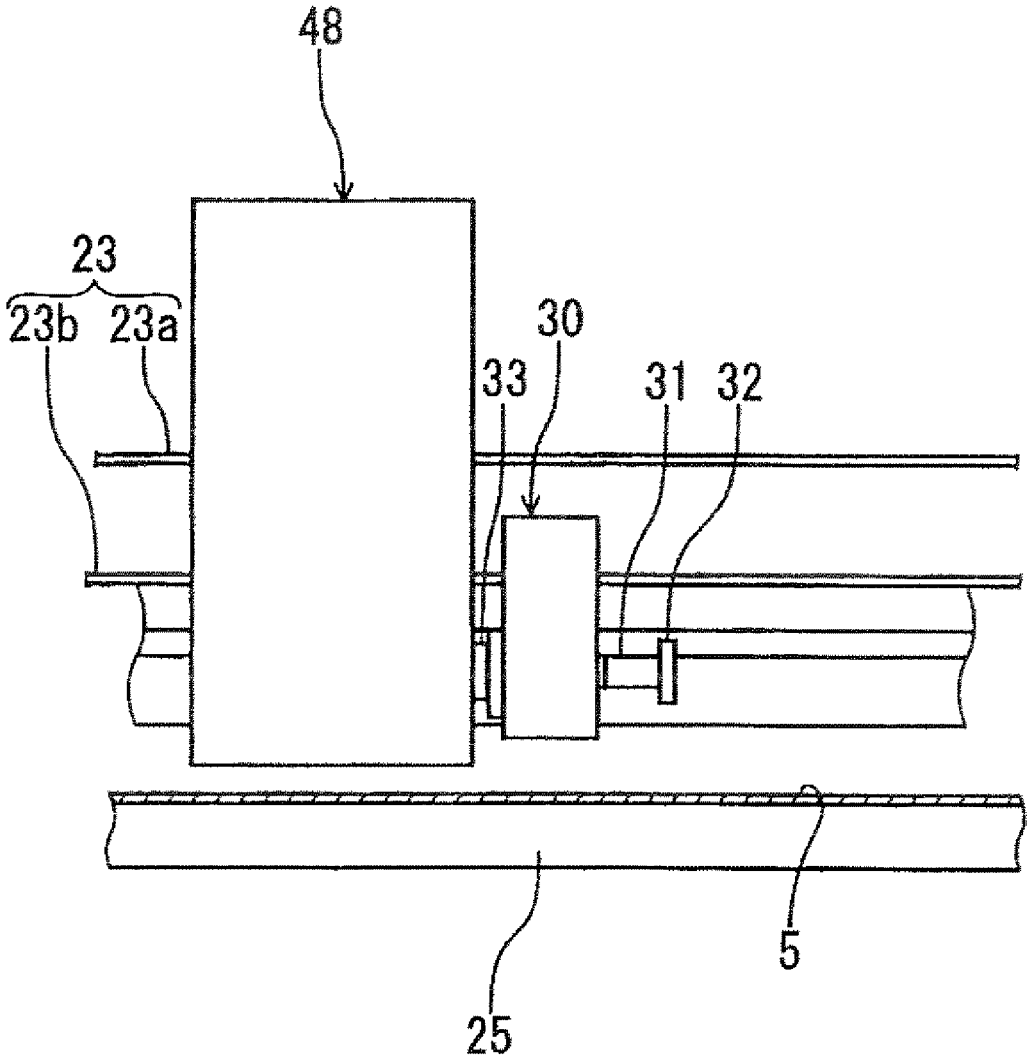
FIG. 12 is a front view of the carriage and another ink head according to one embodiment.

In embodiments described above, among the plurality of heads provided on the ink jet printer 1, a head other than the ink head 40 (that ejects ultraviolet light curable ink) is the cutting head 70. However, the head other than the ink head 40 is not limited to the cutting head 70. For example, as shown in FIG. 12, the other head may be an ink head 48 that ejects an ink different from ultraviolet light curable ink. Accordingly, the same effects described above (or effects similar to those described above) can be obtained by an ink jet printer that is capable of printing with ultraviolet light curable ink as well as other types of ink.

In embodiments described herein, a "recording medium" may refer to a medium where characters or images or the like can be formed by having ink adhere on its surface or in its interior, and its material is not particularly limited. Materials for the recording medium may be, for example, paper, resin, aluminum, iron, wood, and the like. Furthermore, the shape of the recording medium is not limited in any way. Recording media may include sheet-like media, such as sheets of paper, vinyl sheets, resin sheets, and the like. Moreover, substrates of glass plate and the like may also be included among the recording media.

The "home position" for the head does not necessarily have to be a fixed position, and it may be an arbitrary position within a fixed region. The term "home position" includes both a fixed position and/or a fixed region of positions. For example, the position where the head is disconnected from the carriage, the position where the head stands by, and the position where the head is connected to the carriage may be positions within a predetermined region, and they do not have to be the same.

The foregoing embodiments and advantages are merely exemplary and are not to be construed as limiting the present invention. The present teaching can be readily applied to other types of apparatuses and processes. The description of embodiments of the present invention is intended to be illustrative, and not to limit the scope of the claims. Many alternatives, modifications, and variations will be apparent to those skilled in the art.

What is claimed is:

1. An ink jet recording apparatus comprising:

a guide rail extending in a first direction;

an ink head that slidably engages with the guide rail and discharges an ultraviolet light curable ink toward a recording medium;

a second head that slidably engages with the guide rail;

a carriage that moves along the guide rail;

a first connection mechanism that bridges the carriage and the ink head and detachably and magnetically connects the carriage with the ink head such that the ink head is movable with the carriage along the guide rail;

a second connection mechanism that detachably and magnetically connects the carriage with the second head such that the second head is movable with the carriage along the guide rail; and an ultraviolet light irradiation device that is attached to the ink head to move together with the ink head, that is positioned in front, in rear or below the first connecting mechanism when the carriage and the ink head are connected by the first connecting mechanism, and that irradiates the ultraviolet light curable ink discharged from the ink head on the recording medium with ultraviolet light.

2. The ink jet recording apparatus according to claim 1, wherein a lower end of the carriage is positioned above a lower end of the ultraviolet light irradiation device.

3. The ink jet recording apparatus according to claim 2, wherein the lower end of the carriage is positioned above a lower end of the ink head.

4. The ink jet recording apparatus according to claim 1, wherein a lower end of the carriage is positioned above a lower end of the ink head.

5. The ink jet recording apparatus according to claim 1, further comprising a control device that controls movements of the carriage, wherein the ink head becomes connected to or detached from the carriage at a home position located at a first end portion of the guide rail and stands by at the home position when detached from the carriage, wherein, when the carriage is connected to the second head, the control device controls the carriage to reciprocate between a first position located at a second end portion of the guide rail, the second end portion located opposite the first end portion of the guide rail, and a second position located between the second end portion of the guide rail and the home position, and wherein, when the carriage is connected to the second head and moves to the second position, the carriage is spaced apart from the ultraviolet light irradiation device and a front end of the carriage is positioned in front of a rear end of the ultraviolet light irradiation device.

6. The ink jet recording apparatus according to claim 1, wherein the guide rail is disposed in rear of the center of the ink head with respect to a second direction generally perpendicular to the first direction, and the first connecting mechanism is disposed in rear of a front end of the ultraviolet light irradiation device.

7. The ink jet recording apparatus according to any one of claim 6, wherein the second connecting mechanism is disposed in rear of the front end of the ultraviolet light irradiation device.

8. The ink jet recording apparatus according to claim 1, wherein the guide rail is disposed in rear of the center of the ink head with respect to a second direction generally perpendicular to the first direction, and the second connecting mechanism is disposed in rear of a front end of the ultraviolet light irradiation device.

9. The ink jet recording apparatus according to claim 1, further comprising:

a casing having a platen on which the recording medium is positioned;

a transfer mechanism that transfers the recording medium in a direction traversing an axial direction of the guide rail; and an ultraviolet light irradiation body that is affixed to the casing, positioned in front of the guide rail, extends parallel to the guide rail, and irradiates the ultraviolet light curable ink discharged from the ink head on the recording medium with ultraviolet light in association with the transfer of the recording medium by the transfer mechanism, wherein the ink head becomes connected to or detached from the carriage at a first home position located at a first end portion of the guide rail and stands by at the first home position when detached from the carriage, wherein the second head becomes connected to or detached from the carriage at a second home position located at a second end portion of the guide rail, the second end portion located opposite the first end portion of the guide rail, and stands by at the second home position when detached from the carriage, and wherein the ultraviolet light irradiation body is disposed between the first home position and the second home position with respect to the first direction.

10. The ink jet recording apparatus according to claim 1, wherein the ultraviolet light irradiation device is an ultraviolet light light-emitting diode (LED).

11. The ink jet recording apparatus according to claim 1, wherein the second head is a cutting head having a cutter and configured to cut the recording medium with the cutter.

12. The ink jet recording apparatus according to claim 1, wherein the second head is an ink head that ejects an ink different from the ultraviolet light curable ink toward the recording medium.

* * * * *